US005842746A

United States Patent [19]

Rogers

[11] Patent Number: 5,842,746

[45] Date of Patent: Dec. 1, 1998

[54] FURNITURE PROTECTION DEVICE

[76] Inventor: Edward S. Rogers, 5412 W. 56th St., Indianapolis, Ind. 46254

[21] Appl. No.: 985,329

[22] Filed: Dec. 4, 1997

Related U.S. Application Data

[63] Continuation-in-part of Ser. No. 798,063, Feb. 11, 1997, abandoned.

[51] Int. Cl.[6] ..... A47C 31/00

[52] U.S. Cl. ..... 297/463.2; 297/219.1; 182/196

[58] Field of Search ..... 297/219.1, 463.1, 297/463.2, DIG. 6; 119/174, 706; 182/196, 197, 198

[56] References Cited

U.S. PATENT DOCUMENTS

| | | | |
|---|---|---|---|
| 806,706 | 12/1905 | Parker | 182/197 |
| 2,708,543 | 5/1955 | Matich | 182/196 |
| 2,927,329 | 3/1960 | Johannis | 182/196 X |
| 3,464,516 | 9/1969 | Remele | 182/196 X |
| 4,098,372 | 7/1978 | Luckey | 182/196 |

FOREIGN PATENT DOCUMENTS

| | | | |
|---|---|---|---|
| 1240694 | 8/1960 | France | 182/196 |
| 2388124 | 12/1978 | France | 182/196 |
| 8901410 | 1/1991 | Netherlands | 182/196 |

*Primary Examiner*—Peter R. Brown

[57] ABSTRACT

A furniture protection device is disclosed that includes a plurality of angle members arranged in parallel adjacent position. Each angle member includes two intersecting surfaces that define a sharp edge. The angle members are flexibly attached to one another by ropes inserted through apertures in the angle members. The ropes include knots at each end to retain the angle members on the ropes. In an alternate embodiment, additional knots are disposed along the length of the ropes. The additional knots are located between apertures of each individual angle member to maintain the position of each of the angle members with respect to the ropes. In another embodiment, a plurality of elastic fabric strips are attached to a pair of long fabric strips to form elastic apertures therein. A plurality of angle members are inserted into corresponding ones of the elastic apertures in each of the pair of fabric strips so that the angle members are spaced apart and all oriented in a single direction to form an uncomfortable surface for household pets.

9 Claims, 8 Drawing Sheets

FURNITURE PROTECTION DEVICE

RELATED APPLICATION INFORMATION

This application is a continuation in part of my application Ser. No. 08/798,063, filed Feb. 11, 1997, now abandoned, entitled Furniture Protection Device.

FIELD OF THE INVENTION

The present invention relates generally to the field of protective covers for furniture and, more specifically, to devices for discouraging household pets and the like from lying or resting upon furniture.

BACKGROUND OF THE INVENTION

Household pets are well known for perching upon and sleeping on furniture. Cats, as well as indoor canine pets, have a propensity to find a comfortable location to lie upon. Chairs, sofas, and beds are preferred locations as such present soft, cushioned and comfortable areas to the pet. The typical result is a collection of dirt and animal hair upon one's valued furniture. In worst case scenarios, the household pet may regurgitate, urinate or defecate upon the owner's valuable furniture.

It is well known that animals may be discouraged verbally from resting atop furniture when the pet owner is present, but, when the owner is away, the cats and dogs will play, or rest, on the owner's furniture. Cats in particular are notoriously independent creatures and respect no property boundaries.

Frustration and anger are often the result when a pet owner discovers the damage done by the beloved family pet. Discipline is ineffective with cats, and in many instances, may be regarded as cruelty to animals. Cats neither understand nor comprehend the desires of their master to preserve the appearance and condition of household furniture.

There are several protective devices known for discouraging pets from settling on furniture, cars, and the like. These devices are shown in the following patents: U.S. Pat. No. 5,488,981 to Burkhart, entitled Protective Pad Device For Vehicles; U.S. Pat. No. 4,951,993 to Taboada, entitled Accordion Pleated Vehicle Cover; and U.S. Pat. No. 4,343,848 to Leonard, Jr., entitled Embossed Thermoplastic Material.

Removably attachable furniture covers that are known are shown in U.S. Pat. No. 5,441,789 to Walker, entitled Attachable Type Beach Towel For Universal Use, and U.S. Pat. No. 4,383,712 to Kaganas, entitled Composite Seat Cover.

Other related devices for discouraging animal presence and-or providing an uneven surface to discourage animal presence are disclosed in U.S. Pat. No. 199,941 to Street entitled Improvement In Railway Cattle Guards, and U.S. Pat. No. 377,786 to Stowe entitled Mat For Horse Stalls.

A simple to use, inexpensive to manufacture, easily stored and readily deployable furniture protection devices is needed.

SUMMARY OF THE INVENTION

A furniture protection device according to one aspect of the present invention includes a plurality of angle members, each having a first surface, a second surface and wherein the first surface and the second surface intersect to form an elongated sharp edge, and wherein the first surface and the second surface each have a first hole and a second hole therein, a first flexible member situated through each first hole of the first surfaces and through each first hole of the second surfaces, a second flexible member situated through each second hole of the first surfaces and through each second hole of the second surfaces, and wherein the first and second flexible members connect the plurality of angle members into a substantially parallel spaced-apart array and wherein the elongated sharp edge of each of the angle members projects substantially uniformly in a single direction.

A furniture protection device according to another aspect of the present invention includes a plurality of angle members, each having a first surface and a second surface and wherein the first surface and the second surface intersect to form an elongated sharp edge, and means for resiliently and flexibly attaching the angle members into a substantially parallel spaced-apart array and wherein the elongated sharp edge of each of the angle members projects substantially uniformly in a single direction.

A furniture protection device according to yet another aspect of the present invention includes a plurality of elongated rigid strips, wherein each of the strips has an elongated sharp edge, and resilient means for flexibly attaching the plurality of elongated rigid strips into a substantially parallel spaced-apart array and wherein the resilient means positions each of the plurality of elongated rigid strips so that the elongated sharp edge projects upward when the device is placed upon a horizontal surface.

A furniture protection device according to another aspect of the present invention comprises a plurality of angle members, each having a first surface, a second surface and wherein the first surface and the second surface intersect to form an elongated sharp edge, a first flexible strip having a plurality of apertures therein spaced apart at even intervals, a second flexible strip having a plurality of apertures therein spaced apart at even intervals, and wherein the first flexible strip and the second flexible strip are substantially similar, and wherein each of the plurality of angle members is situated within one of the plurality of apertures in the first flexible strip and inserted disposed within a corresponding one of the plurality of apertures in the second flexible strip to form a substantially parallel spaced-apart array of the angle members and wherein the elongated sharp edge of each of the angle members projects substantially uniformly in a single direction.

One object of the present invention is to provide an improved furniture protection device.

Another object of the present invention is to provide an easily manufactured furniture protection device.

Yet another object of the present invention is to provide a furniture protection device that is readily deployed yet greatly reduced in size when arranged for storage.

Still another object of the present invention is to provide a furniture protection device that is made from low cost raw materials, extensible in size, and easily stored in a compact form.

These and other object of the present invention will become more apparent from the following description of the preferred embodiments.

DESCRIPTION OF THE PREFERRED EMBODIMENT

Figure 1:
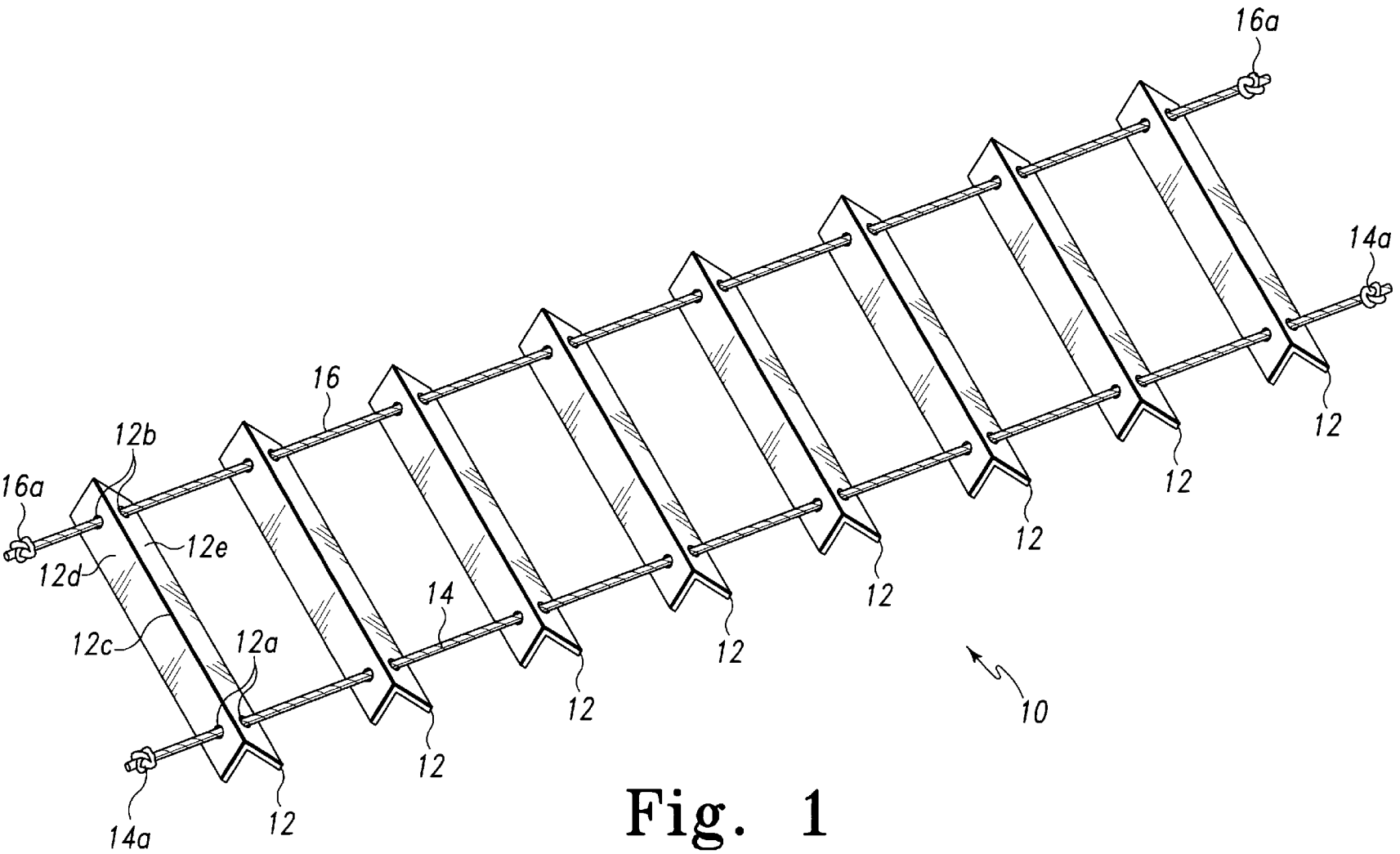
FIG. 1 is a perspective view of a furniture protection device according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
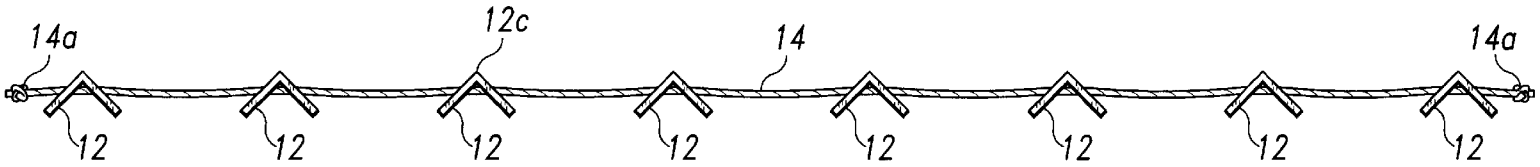
FIG. 2 is a front view of the furniture protection device of FIG. 1.

Referring now to FIGS. 1 and 2, a furniture protection device 10 according to the present invention is shown. Device 10 includes a plurality of angle members 12. Angle members 12 are constructed of plastic, wood or metallic materials. Device 10 also includes a rope or string 14 and a second rope or string 16. Each of the angle members shown has four apertures or holes therein identified at 12*a* and 12*b*. Rope 14 is inserted through holes 12*a* in each of the angle members and rope 16 is inserted through holes 12*b* of each angle member so that the angle members 12 are arranged in parallel adjacent fashion as shown in FIGS. 1 and 2. Each of the angle members 12 includes a sharp edge 12*c* formed by the intersection of planar surfaces 12*d* and 12*e*.

Angle members 12 are movable along ropes 14 and 16 and retained upon the ropes by knots 14*a* and 16*a*. It is contemplated that a variety of techniques may be used to retain angle members 12 on the ropes 14 and 16, including but not limited to the following devices or means for retaining: staples; glue; beads or other items glued to the ends of ropes 14 and 16. It is also contemplated that ropes 14 and 16 may be made of flexible plastic materials with molded beads or retaining tabs in place of knots 14*a* and 16*a*.

Furniture protection device 10 is placed upon the upper surfaces of furniture, tables and the like in spread apart fashion as shown in FIGS. 1 and 2 when in use. Edge 12*c*, defined by the intersection of planar surfaces 12*d* and 12*e*, presents an uncomfortable resting place for household pets such as cats and dogs.

Figure 3:
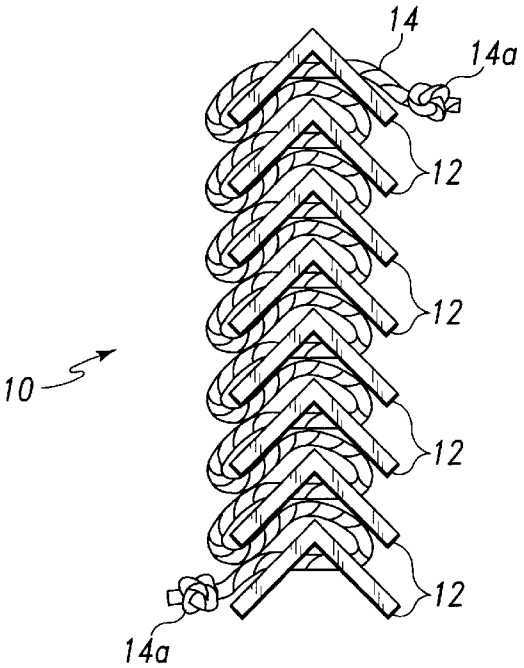
FIG. 3 is a front view of the furniture protection device of FIG. 1 wherein the device is arranged in a stacked configuration for storage purposes.

Referring now to FIG. 3, a side view of device 10 is shown wherein the angle members 12 are stacked one atop the next so that the size or volumetric displacement of furniture protection device 10 is minimized for storage. Device 10 may be inserted into a convenient storage sack or wrapped with a rubber band to maintain the depicted arrangement of the angle members 12 with respect to one another.

Figure 4:
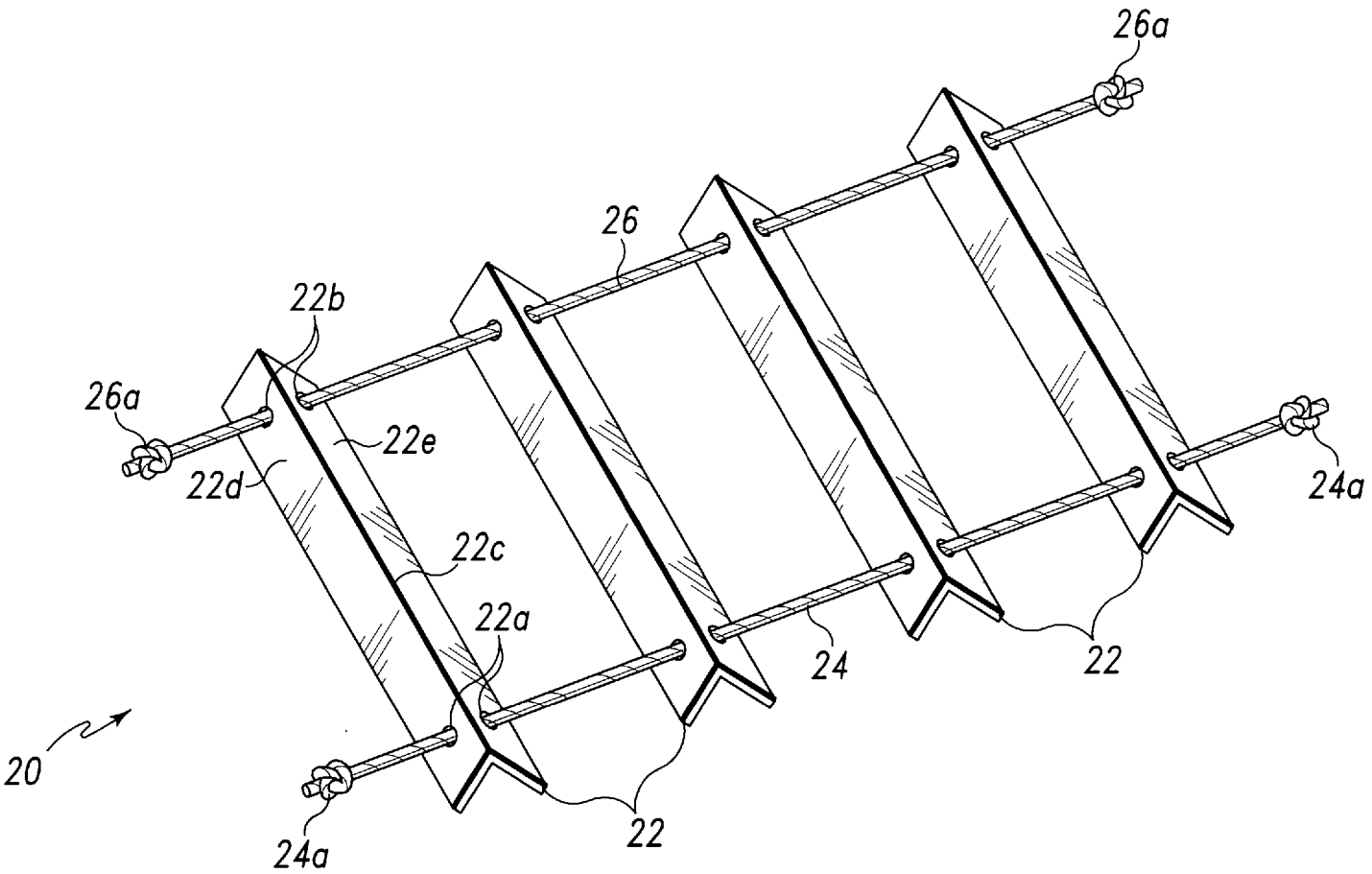
FIG. 4 is a perspective view of another furniture protection device according to the present invention.

FIG. 4 depicts furniture protection device 20, an alternate embodiment of device 10 (FIGS. 1–3), and is shown to illustrate the flexible sizing nature of the present invention for smaller applications thereof. The device 20 consists of angle members 22, rope 24 and rope 26. Angle members 22 include all of the features of angle members 12 of FIG. 1, including apertures at 22*a* and 22*b*, and a sharp edge 22*c* defined by surfaces 22*d* and 22*e*. Ropes 24 and 26 includes knots 24*a* and 26*a*, respectively.

It is also contemplated that furniture protection device 10 includes a number of angle members 12 in excess of that shown in FIGS. 1–3 to create a much larger furniture protection device. In addition the length of each angle member 12 may be increased so that the entire surface area of a queen or king sized bed may be protected.

Figure 5:
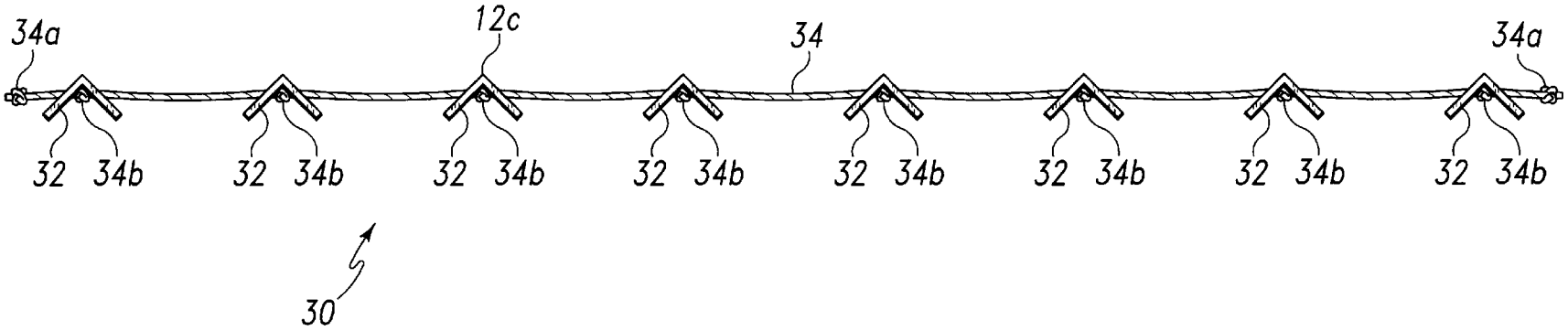
FIG. 5 is a front view of yet another furniture protection device according to the present invention.

Referring now to FIG. 5, a side view of an alternative embodiment of a furniture protection device 30 according to the present invention is shown. Device 30 is identical in constituency with the components of device 10 with the exception being the added knots 34*b* and 36*b* in ropes 34 and 36, respectively. With the addition of knots 34*b* and 36*b* the location of angle members 32 is fixed with respect to the ropes 34 and 36. Angle members 32 are fixed in parallel adjacent arrangement by knots 34*b* and 36*b* when ropes 34 and 36 are extended or stretched linearly. It is contemplated that knots 34*b* and 36*b* may be replaced with fixation devices attached to the ropes 34 and 36 at the locations where knots 34*b* and 36*b* are found. Such fixation devices may be clamped, stapled or glued to the ropes to accomplish the desired functionality of maintaining the angle members 32 in a particular position along the ropes 34 and 36.

Figure 6:
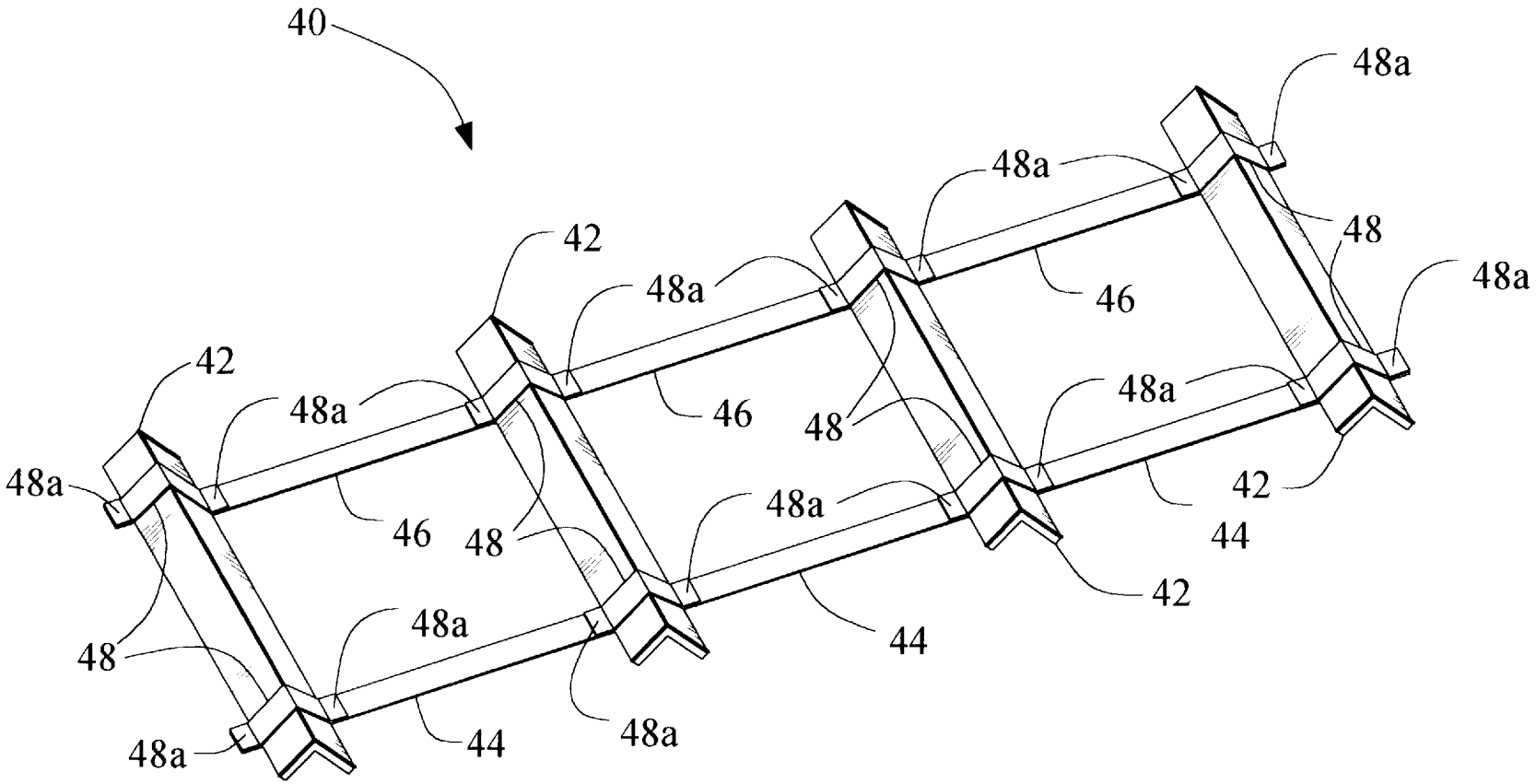
FIG. 6 is a perspective view of another furniture protection device according to the present invention.

Referring now to FIG. 6, another embodiment of a furniture protection device 40 according to the present invention is shown. Furniture protection device 40 includes angle brackets or angle members 42, flexible strips 44 and 46 and elastic strips 48. Elastic strips 48 are attached to flexible strips 44 and 46 at the distal ends 48*a* thereof to form a plurality of apertures at spaced apart regular intervals as shown in FIG. 6. Angle members 44 and 46 are disposed within the apertures defined by flexible strips 44 and 46 and elastic strips 48. Angle members 44 and 46 are oriented so that edge 44*a* of each angle member 48 projects in a uniform direction, normally upward, when the device 40 is placed upon a chair, sofa or the like.

Angle members 42 are made of plastic, wood or metal. Flexible strips 44 and 46 are made of woven cloth straps such as those used in backpack gear and the like. Elastic strips 48 are elastic cloth strips that are attached to strips 44 and 46 using conventional sewing technology. Alternatively, strips 44 and 46 are made of flexible plastic strips such as nylon and the like, and elastic strips are made of any elastic material that is readily attached to plastic using adhesives.

Figure 7:
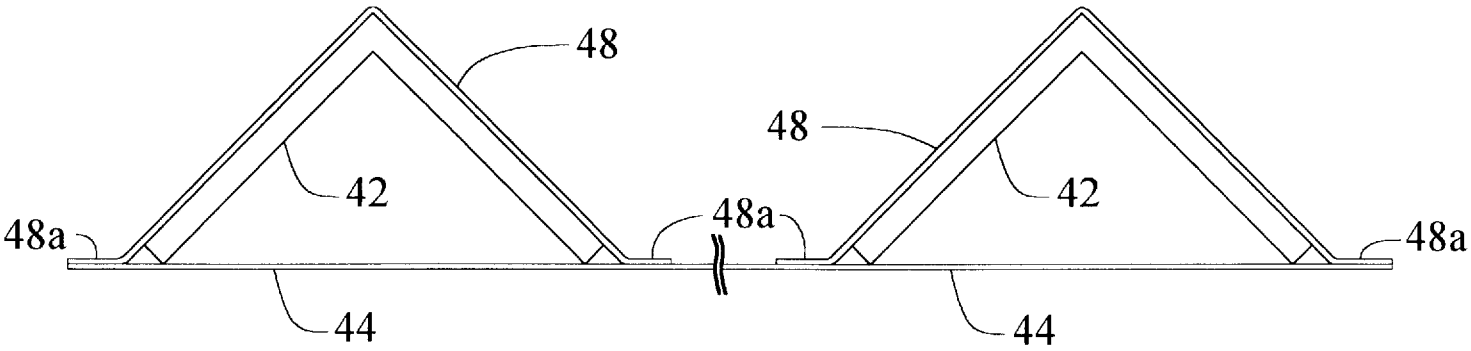
FIG. 7 is a partial front view of the furniture protection device of FIG. 6.

Referring now to FIG. 7, a partial front view of the furniture protection device 40 is shown. Angle members 42 are shown disposed within the aperture defined by flexible strip 44 and elastic strips 48. FIG. 7 reveals enhanced detail regarding the flexible strip 44 and the elastic strips 48 attached thereto. Specifically, the elastic strips 48 are attached to flexible strip 44 at locations 48*a* using conventional sewing techniques or adhesives. Similarly, elastic strips 48 are attached to flexible strip 46 (not shown in FIG. 7) in the same fashion.

Figure 8:
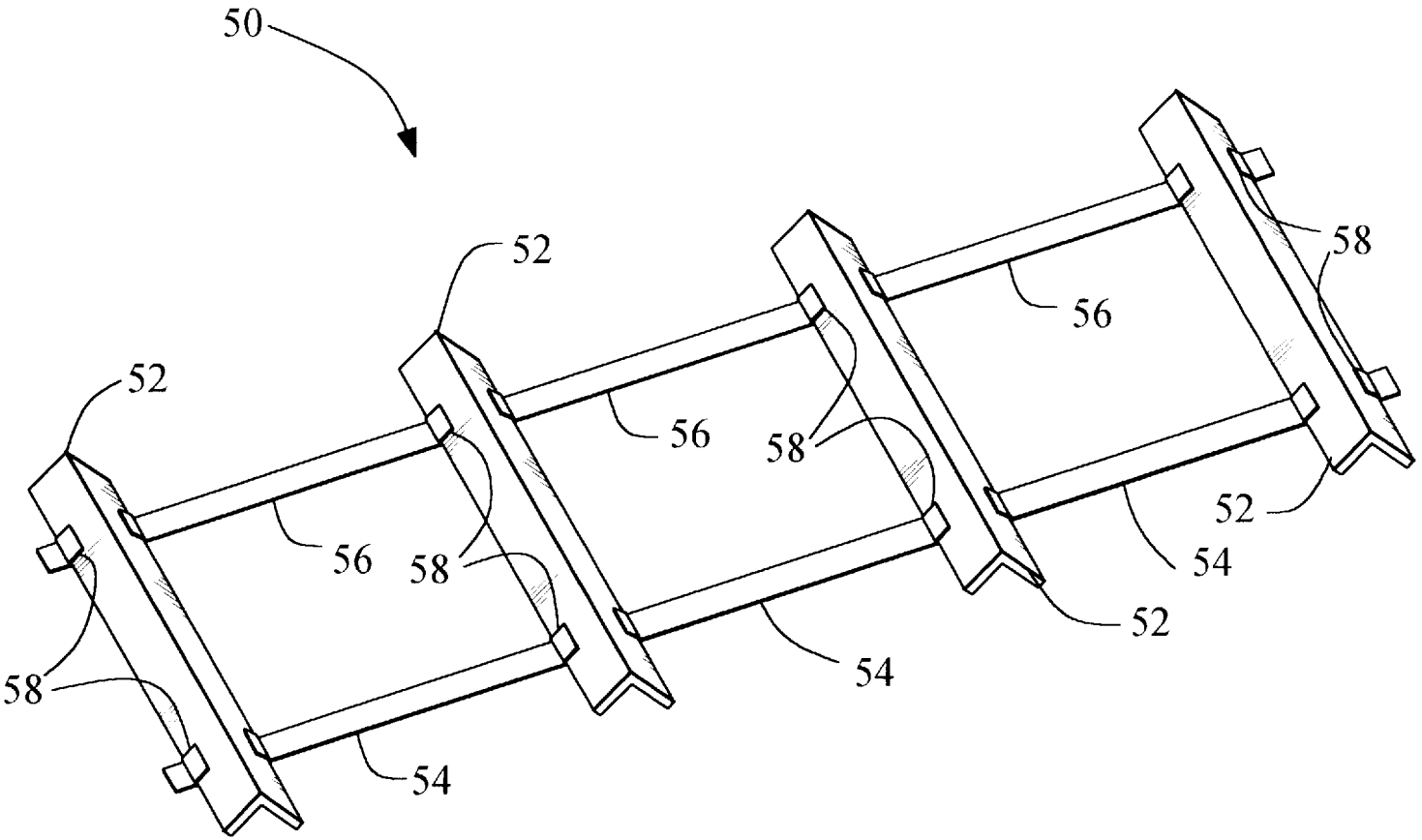
FIG. 8 is a perspective view of another furniture protection device according to the present invention.
Figure 9:
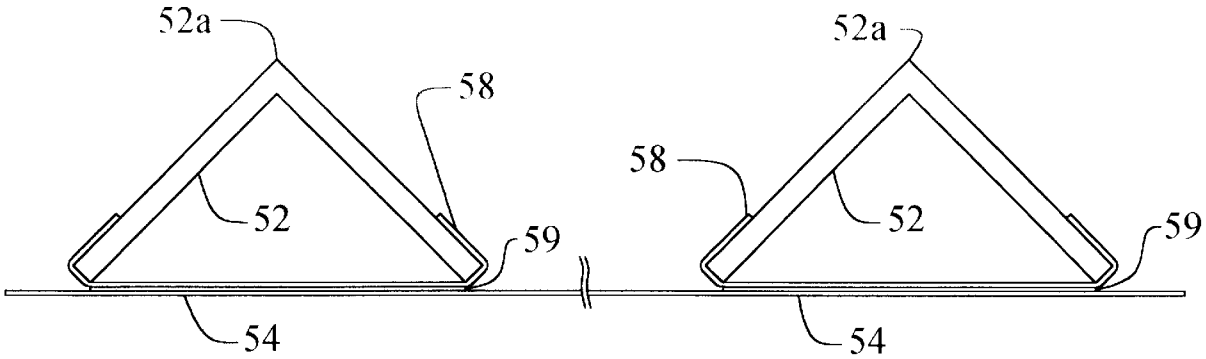
FIG. 9 is a partial front view of the furniture protection device of FIG. 8.

Referring now to FIG. 8, a perspective view of another embodiment of a furniture protection device 50 according to the present invention is shown. Device 50 includes a plurality of elongated angle members 52 arranged in a spaced-apart parallel fashion. Flexible strips 54 and 56 are disposed beneath the angle members 52 in substantially parallel arrangement as shown. Loop strips 58 of a hook and loop fastener well known in the art are attached to angle members 52 using an adhesive or other method well known in the art. The relative position of strips 58 with respect to angle members 52 is consistent on each angle member 52. Hook strips 49 (shown in FIGS. 9 and 10) of a hook and loop fastener are attached to flexible strips 54 and 56 at locations wherein it is desired to attach angle members 52 thereto. The location of the hook strips 49 attached to flexible strips 54 and 56 is directly beneath the location shown for the flexible angle members 52.

Angle members 52 are made from wood, metal, plastic or other suitable material. Flexible strips 54 and 56 are made of woven cloth strips, plastic, or other material suitable as a flexible material to which the loop portion of a hook and loop fastener may be attached using adhesives, staples, nails, or other suitable fastener means well known in the art. Although the flexible strips 54 and 56 are depicted in a linear fashion, Referring now to FIG. 9, a partial front view of the furniture a protection device 50 according to the present invention is shown. Angle members 52 are shown disposed over and substantially adjacent flexible strip 54. Sharp edges 52*a* of angle members 52 protrude upward thereby creating an uneven and uncomfortable surface upon which a pet might attempt to situate itself. Hook strips 59, attached to flexible strip 54 at spaced-apart locations, engage loop strips 58 to provide a mechanism for removably attaching flexible members 54 to angle members 52.

Figure 10:
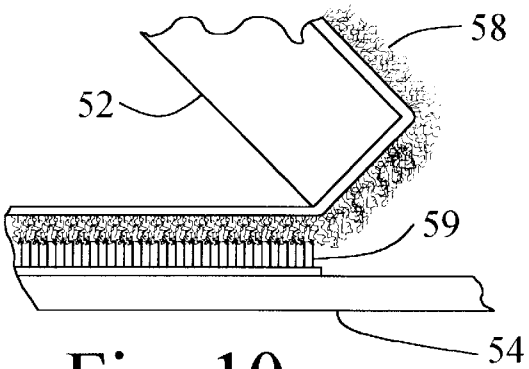
FIG. 10 is an enlarged partial front view of the furniture protection device of FIG. 8 illustrating enhanced detail of the components of the invention.

Referring now to FIG. 10, a magnified partial front view of the furniture protection device 50 is shown. Flexible strip 54, angle member 52, loop strip 58 and hook strop 59 are shown. Loop strip 58 is attached to angle member 52 using adhesives or the like. Hook strip 59 is attached to and adjacent flexible strip 54. Hook strip 59 is attached to flexible strip 54 using adhesives, stitching or other techniques well known in the art. Specifically illustrated in FIG. 10 is the mechanical attachment and interaction of loop strip 58 with hook strip 59.

It is contemplated that a variety of removable fastener means such as snaps, may be used in place of the hook and loop fastener comprised of items 58 and 59. Yet another useful application of a hook and loop fastener is achieved in this embodiment to achieve a readily assembled, and disassembled device useful in the protection of furniture from pet animals.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A furniture protection device comprising:

a plurality of angle members, each having a first surface, a second surface and wherein said first surface and said second surface intersect to form an elongated sharp edge;

a first flexible strip;

a second flexible strip disposed in substantially parallel arrangement with said first flexible strip; and means for removably attaching said plurality of angle members to said first flexible strip and to said second flexible strip in a spaced apart arrangement, substantially perpendicular to said first and second flexible strips, and wherein said means for removably attaching includes a plurality of hook and loop fasteners each having a hook portion and a loop portion, and wherein said plurality of hook portions are attached to said first and second flexible strips and wherein said loop portions are attached to each of said plurality of angle members.

2. The device of claim 1 wherein said plurality of angle members are made of plastic.

3. The device of claim 2 wherein said first flexible strip and said second flexible strip are made from plastic.

4. The device of claim 2 wherein said first flexible strip and said second flexible strip are cloth strips.

5. A furniture protection device comprising:

a plurality of angle members, each having a first surface and a second surface and wherein said first surface and said second surface intersect to form an elongated sharp edge; and means for resiliently and removably attaching said angle members into a substantially parallel spaced-apart array and wherein the elongated sharp edge of each of said angle members projects substantially uniformly in a single direction, wherein said means for resiliently and removably attaching includes a first flexible strip, a second flexible strip, and means for removably fastening said plurality of angle members to said first and second flexible strips, said means for removably fastening including a plurality of hook and loop fasteners each having a hook portion and a loop portion, and wherein said plurality of hook portions are attached to said first and second flexible strips and wherein said loop portions are attached to each of said plurality of angle members.

6. The device of claim 5 wherein said angle members are made of plastic and wherein said first and second flexible strips are cloth strips.

7. A furniture protection device comprising:

a plurality of elongated members having a triangular cross-section;

a first flexible strip;

a second flexible strip disposed in substantially parallel arrangement with said first flexible strip; and means for removably attaching said plurality of elongated members to said first flexible strip and to said second flexible strip in a spaced apart arrangement, wherein said elongated members are disposed substantially perpendicular to said first and second flexible strips; and wherein said means for removably attaching includes a plurality of hook and loop fasteners each having a hook portion and a loop portion, and wherein said plurality of hook portions are attached to said first and second flexible strips and wherein said loop portions are attached to each of said plurality of angle members.

8. The device of claim 7 wherein said plurality of elongated members are made of plastic.

9. The device of claim 8 wherein said first flexible strip and said second flexible strip are cloth strips.

* * * * *